United States Patent [19]

Bryant

[11] 3,935,603

[45] Feb. 3, 1976

[54] ADJUSTABLE HANGER HANDLE FOR A CRIB FRAME

[75] Inventor: Robert G. Bryant, Gardner, Mass.

[73] Assignee: GEM Industries, Inc., Gardner, Mass.

[22] Filed: Mar. 31, 1975

[21] Appl. No.: 563,851

[52] U.S. Cl. ..... 5/11; 5/200 R

[51] Int. Cl.[2] ..... A47C 31/00

[58] Field of Search ..... 297/441, 452, 456; 5/11, 5/100, 200 R; 211/105.3; 52/753 C, 753 D, 758 D; 248/308, 340, 226 E, 254; 16/114, 110 A

[56] References Cited

UNITED STATES PATENTS

| | | | |
|---|---|---|---|
| 1,336,397 | 4/1920 | Travis et al. | 5/200 R |
| 2,481,802 | 9/1949 | Wadkins | 248/254 |
| 2,532,236 | 11/1950 | Klazkin | 5/11 |
| 2,842,329 | 7/1958 | Friedman et al. | 248/308 |
| 2,936,148 | 5/1960 | Gralewicz | 248/308 |
| 3,000,018 | 9/1961 | Collins | 5/82 |
| 3,469,710 | 9/1969 | Vosbikian | 248/308 X |
| 3,628,780 | 12/1971 | Haijima-cho | 297/456 |
| 3,883,905 | 5/1975 | Bryant | 5/11 |

*Primary Examiner*—Casmir A. Nunberg
*Assistant Examiner*—Andrew M. Calvert
*Attorney, Agent, or Firm*—Charles R. Fay

[57] ABSTRACT

In a mattress support including a tubular frame which comprises elongated longitudinal side members and shorter transverse end members, the combination with a hanger handle which includes a straight elongated shank with a hook at one end thereof. The short transverse end member of the frame is indented in a semicircular conformation adjacent the junction with a longitudinal side member for the sliding reception of said elongated shank, there being in spaced relation to said indentation a second indentation which also receives the hanger shank thereby providing a pair of spaced supports for said shank.

1 Claim, 6 Drawing Figures

ADJUSTABLE HANGER HANDLE FOR A CRIB FRAME

BACKGROUND OF THE INVENTION

In beds and particularly in cribs it is important to provide for adjustments of the mattress in a vertical direction and this is ordinarily done by providing the mattress spring frame with four hangers including hooks or pins, one adjacent each corner thereof, in combination with hanger brackets receiving the hooks or pins, said hanger brackets being on the bed, e.g., on the corner posts of the crib.

Many means for attaching these hangers with respect to the bed or crib ends have been proposed and a very simple swinging hook arrangement is ordinarily preferred for ease of attachment. However the problem is to provide a simple, inexpensively manufactured device. It is an important consideration to provide parts easily assembled by the mother or nurse and also that they shall be safe in supporting the spring frame of the mattress without danger of falling once they have been placed in position on the brackets.

SUMMARY OF THE INVENTION

In the present case there is provided a continuous rectangular tubular frame for supporting the mattress and this tubular frame comprises longitudinal side members and transverse end members often made in a single piece.

Adjacent a corner between an end member and a longitudinal side member there is provided in the end member an indentation by cutting the material of the end member partially through the same and then indenting the material between the cut and the corner forming a substantially semicircular conformation which is opposite to the curvature of the tubular member; and there is a second such indentation in spaced relation thereto. A hanger having an elongated shank is inserted therein and finds two slide or guide supports in spaced relation interiorly of the tubing.

No particular means of mechanically connecting the hanger to the tubular member is necessary although the hanger is freely slidable in and out for adjustment but once mounted on the hanger bracket it cannot thereafter be moved.

PREFERRED EMBODIMENT OF THE INVENTION

Figure 1:
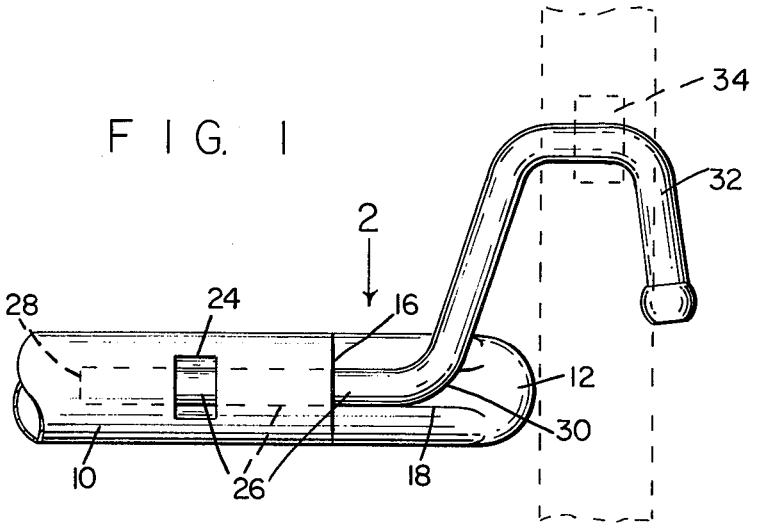
FIG. 1 is a view in end elevation illustrating the invention and showing a corner post of a crib with a hanger bracket in dotted lines.

The reference numeral 10 indicates a transverse end member of a tubular frame which has an elongated side member 12. Such tubular frames are usually indented as at 14 in order to form the bend or corner.

Figure 3:
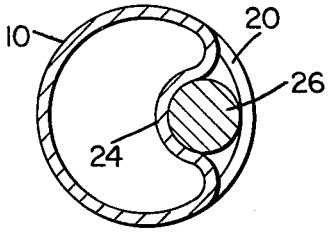
FIGS. 3 and 4 are sections on respective lines in FIG. 2.
Figure 4:
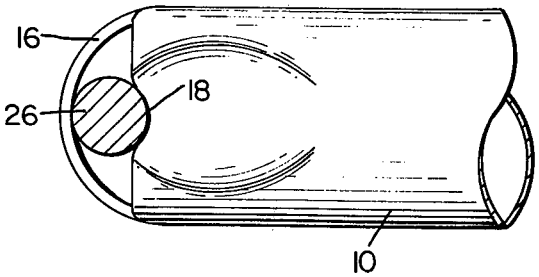

In the present case the material of the tubing is cut at 16 and indented in a kind of semicylindrical form, this being indicated at 18. At a spaced location from the cut at 16 there are two spaced parallel cuts in the tubing at 20 and 22, and the material between these cuts is bent inwardly forming a semicylindrical supporting area 24, see FIG. 3.

The hanger comprises an elongated shank 26 terminating at 28 and having a bend at 30, the bend trending into a hook 32 to be supported on a hanger bracket 34 as shown in dotted lines in FIG. 1.

Figure 2:
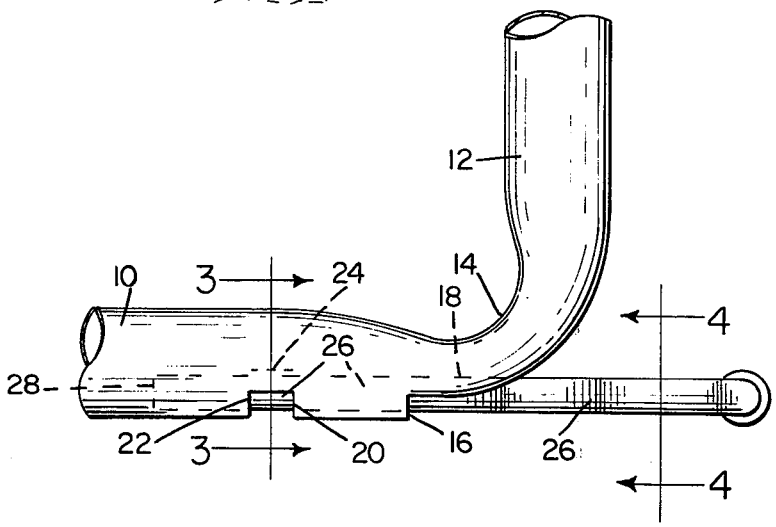
FIG. 2 is a plan view looking in the direction of arrow 2 in FIG. 1.

The elongated shank 26 of the hanger is slidably located inside the tubing and is slidably supported by the outside wall of the tubing as shown in FIGS. 1 and 2, and also by the indented areas at 18 and 24 opposite thereto. The portion 26 of the hanger is freely slidable therein and need have no mechanical interconnection with the tubing. An adjustment is necessary since all hanger brackets 34, 34 will not be spaced apart to exactly the same degree, but once the hook 32 is mounted on the hanger bracket 34, it prevents the hanger from moving as for instance to the right in FIG. 1 so that it cannot become accidentally detached although it can be easily adjusted as required.

Figure 5:
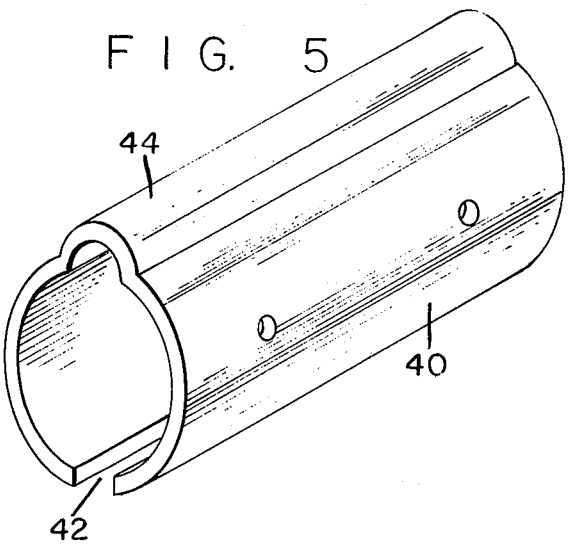
FIGS. 5 and 6 are perspective views showing modifications.

The bracket 40 in FIG. 5 is itself tubular with a longitudinal gap at 42 to allow it to be snapped over the tubing 10. The bracket has a pressed out longitudinal semi-tube 44 receiving the shank 26 of the hanger, as before. The bracket 40 may be riveted or welded in place.

Figure 6:
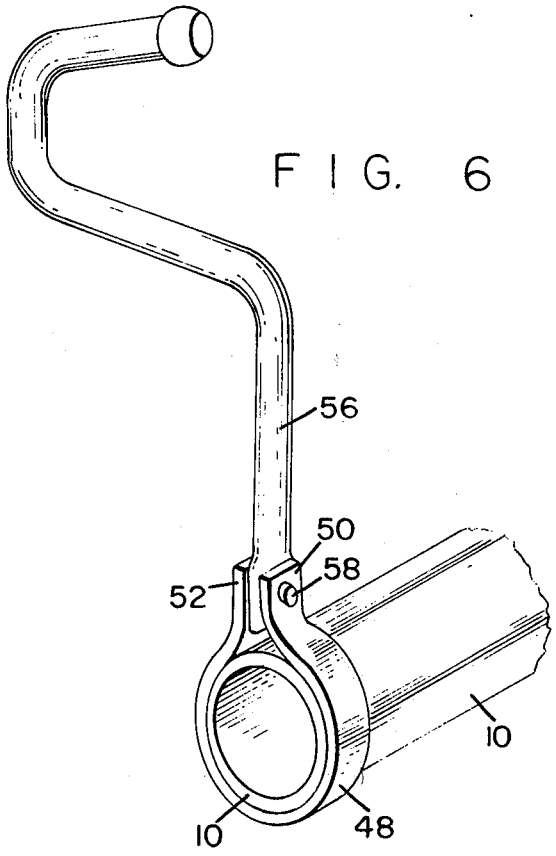

In FIG. 6 a generally cylindrical (annular) strap 48 is placed about tubing 10, and has spaced radial ears 50, 52 to clamp a flat tail 54 of a tubular hanger 56. A pivot or the like 58 may connect the parts together, and allow the hanger to pivot.

I claim:

1. Supporting means for a spring frame of tubing in rectangular shape, said means comprising a hanger having an elongated shank at one end and a hook at the opposite end, and indented means in a portion of said tubing receiving said elongated shank slidably adjustable therein whereby the hanger is slidably adjustable laterally with respect to the spring frame, said indented means comprises a portion of the tubing which is indented oppositely to the general circumference of the tubing and forms a semicylindrical supporting member opposite to an unindented portion of the tubing adjacent thereto, a second indented means spaced from the first indented means along the length of the tubing, said two indented means together forming a two-point sliding support for the elongated shank of the hanger.

* * * * *